United States Patent [19]

Morrell et al.

[11] Patent Number: 4,631,441

[45] Date of Patent: Dec. 23, 1986

[54] COLOR PICTURE TUBE HAVING IMPROVED LINE SCREEN

[75] Inventors: Albert M. Morrell, East Hempfield Township, Lancaster County; Walter D. Masterton, Manheim Township, Lancaster County, both of Pa.

[73] Assignee: RCA Corporation, Princeton, N.J.

[21] Appl. No.: 711,723

[22] Filed: Mar. 14, 1985

[51] Int. Cl.[4] ..... H01J 29/32; H01J 29/07

[52] U.S. Cl. ..... 313/408; 313/461

[58] Field of Search ..... 313/402, 403, 408, 461

[56] References Cited

U.S. PATENT DOCUMENTS

| | | | |
|---|---|---|---|
| 3,590,303 | 6/1971 | Coleclough | 313/92 |
| 3,889,145 | 6/1975 | Suzuki et al. | 313/408 |
| 3,925,700 | 12/1975 | Saito | 313/403 |
| 3,947,718 | 3/1976 | van Lent | 313/408 |
| 4,136,300 | 1/1979 | Morrell | 313/403 |

*Primary Examiner*—Palmer C. DeMeo
*Assistant Examiner*—K. Wieder
*Attorney, Agent, or Firm*—Eugene M. Whitacre; Dennis H. Irlbeck

[57] ABSTRACT

An improvement is made in a color picture tube having a substantially rectangular slit-aperture type shadow mask mounted therein in spaced relation to a substantially rectangular cathodoluminescent line screen. In the specific improvement, the cathodoluminescent lines of said screen, in front plan view, first increase in curvature with an increase in distance from the minor axis of the screen and then decrease in curvature with further increase in distance from the minor axis, to become substantially straight at the short sides of the screen.

2 Claims, 8 Drawing Figures

COLOR PICTURE TUBE HAVING IMPROVED LINE SCREEN

This invention relates to a color picture tubes of the type having a slit-aperture type shadow mask mounted in close relation to a cathodoluminescent line screen of the tube and, particularly, to an improvement in the curvature of the screen lines within such tubes.

Most color picture tubes presently being manufactured are of the line screen-slit mask type. These tubes have spherically contoured rectangular faceplates with line screens of cathodoluminescent materials thereon, and somewhat spherically contoured slit-apertured shadow masks adjacent to the screens. The slit-shaped apertures in such tubes are arranged in columns that substantially parallel the minor axis of the tube or gradually increase in curvature from the center to the short sides of the mask.

Recently, several color picture tube modifications have been suggested. One of these modifications is a new faceplate panel contour concept which creates the illusion of flatness. Such tube modification is disclosed in three recently-filed, copending U.S. applications: Ser. No. 469,772, filed by F. R. Ragland, Jr. on Feb. 25, 1983; Ser. No. 469,774, filed by F. R. Ragland, Jr. on Feb. 25, 1983; and Ser. No. 529,644, filed by R. J. D'Amato et al. on Sept. 6, 1983. The faceplate contour of the modified tube has curvature along both the major and minor axes of the faceplate panel, but is nonspherical. The major and minor axes are defined as the central horizontal and vertical axes, respectively, when the tube is positioned in its normal viewing position. In a preferred embodiment described in these applications, the peripheral border of the tube screen is substantially planar and visually appears to be planar. In order to obtain this planar or substantially planar peripheral border, it is necessary to form the faceplate panel with a curvature along its major axis that is greater at the sides of the panel than at the center of the panel. Such nonspherical shaping of the faceplate panel complicates certain problems involving formation of the cathodoluminescent line screen. One such problem is known as skewing. Skewing is a tilting of the image of a linear light source when it is projected through the mask apertures during a photographic screening process. Such problem was solved in the prior art for spherically contoured tubes by curving the phosphor screen lines so that the lines gradually increased in curvature with increasing distance from the minor axis. Although gradual increase in curvature proved acceptable for spherically contoured tubes, it is not acceptable for the aforementioned planar tubes which require substantially straight lines at the left and right sides of a substantially rectangular screen.

The present invention provides a screen with improved line curvatures which substantially solve the skew problem occurring during the screening process and which has substantially straight lines at the sides of the screen.

SUMMARY OF THE INVENTIION

An improvement is made in a color picture tube having a substantially rectangular slit-aperture type shadow mask mounted therein in spaced relation to a substantially rectangular cathodoluminescent line screen. In the specific improvement, the cathodoluminescent lines of said screen, in plan front view, first increase in curvature with an increase in distance from the minor axis of the screen and then decrease in curvature with further increase in distance from the minor axis, to become substantially straight at the short sides of the screen.

DETAILED DESCRIPTION OF THE PREFERRED EMBODIMENTS

Figure 1:
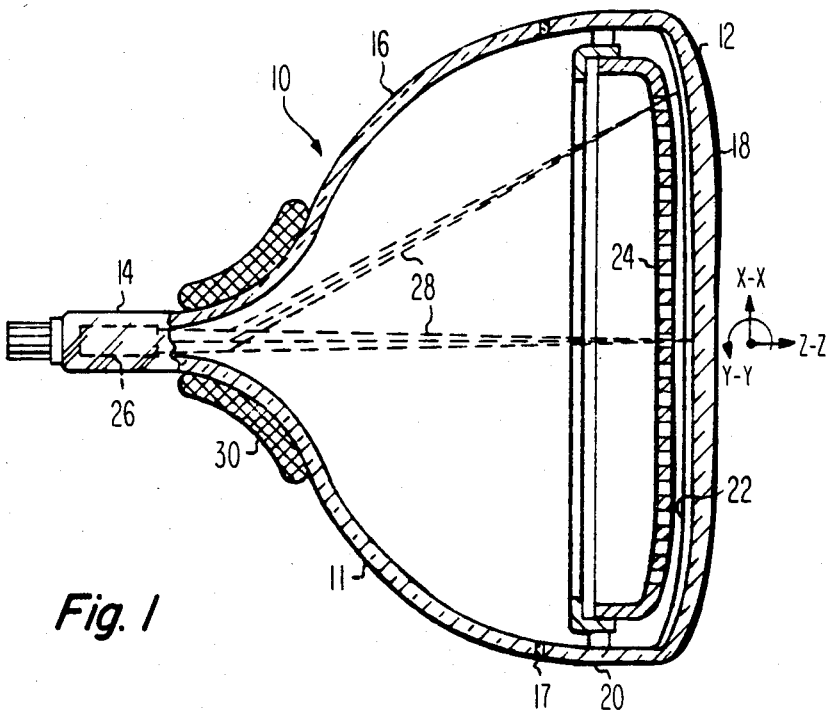
FIG. 1 is a plan side view, partly in axial section, of a shadow mask color picture tube incorporating one embodiment of the present invention.

FIG. 1 shows a rectangular color picture tube 10 having a glass envelope 11, comprising a rectangular faceplate panel 12 and a tubular neck 14 connected by a funnel 16. The panel comprises a viewing faceplate 18 and a peripheral flange or sidewall 20, which is sealed to the funnel 16 by a glass frit 17. A novel rectangular three-color cathodoluminescent phosphor screen 22 is carried by the inner surface of the faceplate 18. The screen is a line screen, with the phosphor lines extending somewhat parallel to the minor axis, Y—Y, of the tube (normal to the plane of FIG. 1). The contours of the phosphor lines are discussed in greater detail below. A novel multi-apertured color selection electrode or shadow mask 24 is removably mounted within the faceplate panel 12 in predetermined spaced relation to the screen 22. An inline electron gun 26, shown schematically by dashed lines in FIG. 1, is centrally mounted within the neck 14 to generate and direct three electron beams 28 along initially coplanar convergent paths through the mask 24 to the screen 22.

The tube 10 of FIG. 1 is designed to be used with an external magnetic deflection yoke, such as the yoke 30 schematically shown surrounding the neck 14 and funnel 16 in the neighborhood of their junction, for subjecting the three beams 28 to vertical and horizontal magnetic flux, to scan the beams horizontally in the direction of the major axis (X—X) and vertically in the direction of the minor axis (Y—Y), respectively, in a rectangular raster over the screen 22.

Figure 2:
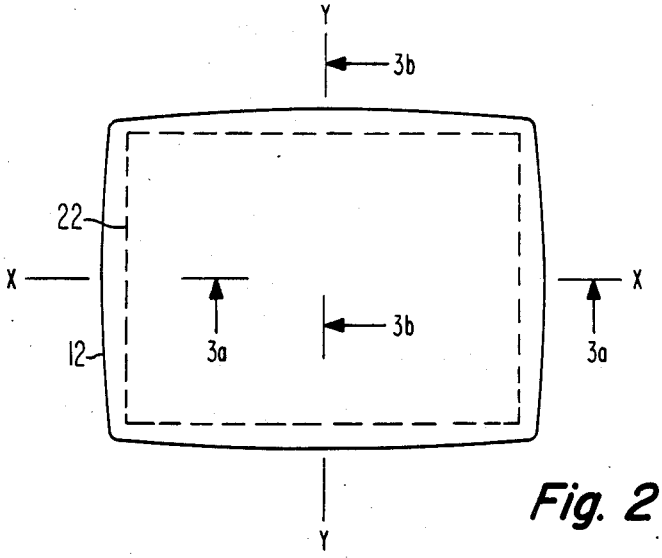
FIG. 2 is a plan front view of the faceplate of the color picture tube, taken at line 2—2 of FIG. 1.

FIG. 2 shows the front of the faceplate panel 12. The periphery of the panel 12 forms a rectangle with slightly curved sides. The border of the screen 22 is shown with dashed lines in FIG. 2. This screen border is rectangular.

Figure 3:
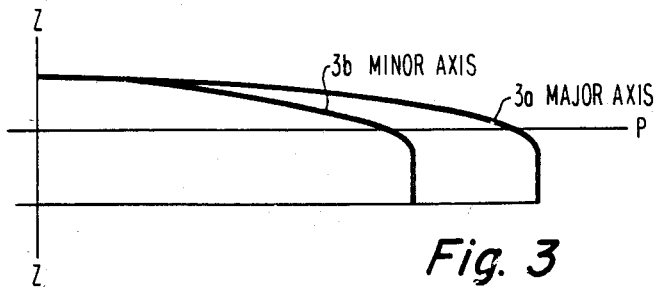
FIG. 3 is a compound view showing the surface contours of the faceplate panel at the major axis, 3*a*—3*a*, and the minor axis, 3*b*—3*b*, cross-sections of FIG. 2.

A comparison of the relative contours of the exterior surface of the faceplate panel 12 along the minor axis, Y—Y, and major axis, X—X, is shown in FIG. 3. The exterior surface of the faceplate panel 12 is curved along both the major and minor axes, with the curvature along the minor axis being greater than the curvature along the major axis in the center portion of the panel 12. For example, at the center of the faceplate, the ratio of the radius of curvature of the exterior surface contour along the major axis to the radius of curvature along the minor axis is greater than 1.1 (a greater than 10% difference). The curvature along the major axis, however, is small in the central portion of the faceplate and greatly increases near the edges of the faceplate. In this one embodiment, the curvature along the major axis, near the edges of the faceplate, is greater than the general curvature along the minor axis. With this design, the central portion of the faceplate becomes flatter, while the points of the faceplate exterior surface at the edges of the screen lie substantially in a plane P and define a substantially rectangular peripheral contour line. The surface curvature along the diagonal is selected to smooth the transition between the different curvatures along the major and minor axes. Preferably, the curvature along the minor axis is about 4/3 greater than the curvature along the major axis in the central portion of the faceplate. However, the curvature along the minor axis also may be similar to that along the major axis at the central portion and increase in curvature near the edges of the faceplate.

By using the differing curvatures along the major and minor axes, the points on the exterior surface of the panel, directly opposite the edges of the screen 22, lie substantially in the same plane P. These substantially planar points, when viewed from the front of the faceplate panel 12, as in FIG. 2, form a contour line on the exterior surface of the panel that is substantially a rectangle superposed on the edges of the screen 22. Therefore, when the tube 10 is inserted into a television receiver, a uniform width border mask or bezel can be used around the tube. The edge of such a bezel that contacts the tube at the rectangular contour line also is substantially in the plane P. Since the periphery border of a picture on the tube screen appears to be planar, there is an illusion created that the picture is flat, even though the faceplate panel is curved outwardly along both the major and minor axes.

Figure 4:
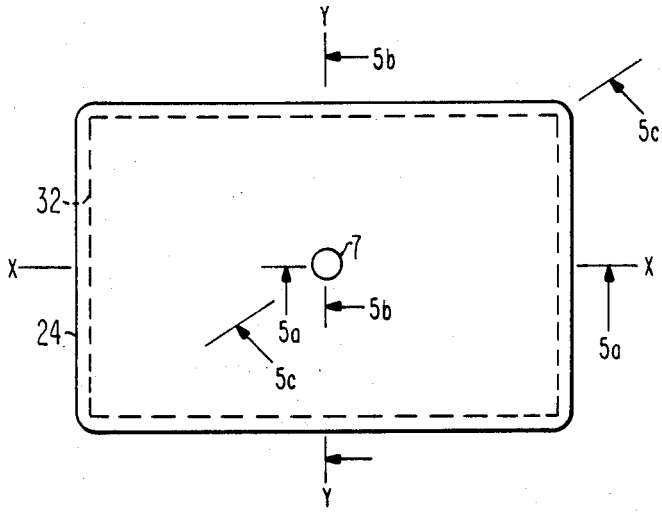
FIG. 4 is a plan front view of the shadow mask of the color picture tube of FIG. 1.
Figure 5:
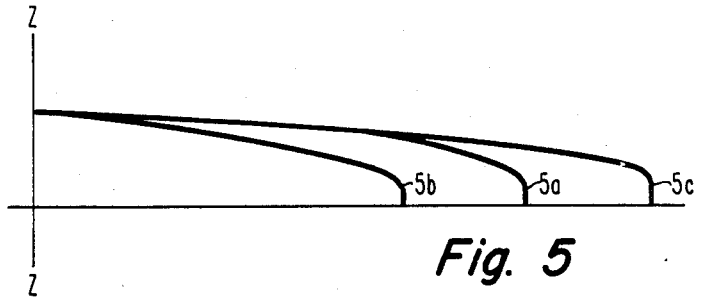
FIG. 5 is a compound view showing the surface contours of the shadow mask at the major axis, 5*a*—5*a*, the minor axis, 5*b*—5*b*, and the diagonal, 5*c*—5*c*, cross-sections of FIG. 4.

FIG. 4 shows a front view of the shadow mask 24. The dashed lines 32 show the border of the apertured portion of the mask 24. The surface contours along the major axis, X—X, the minor axis, Y—Y, and the diagonal of the mask 24 are shown by the curves 5*a*, 5*b* and 5*c*, respectively, in FIG. 5. The mask 24 has a different curvature along its major axis than along its minor axis. The contour along the major axis has a slight curvature near the center of the mask and greater curvature at the sides of the mask. The contour of such a shadow mask can be generally obtained by describing the major axis, X—X, curvature as a large radius circle over about the central portion of the major axis, and a smaller radius circle over the remainder of the major axis. However, more specifically, the sagital height along the major axis varies substantially as the fourth power of distance from the minor axis Y—Y. Sagital height is the distance from an imaginary plane that is tangent to the center of the surface of the mask. The curvature parallel to the minor axis, Y—Y, is such as to smoothly fit the major axis curvature to the required mask periphery and can include a curvature variation as is used along the major axis. Such mask contour exhibits some improved thermal expansion characteristics because of the increased curvature near the ends of the major axis. The production of improved thermal expansion characteristics from increased curvature is discussed in the above-cited U.S. Pat. No. 4,136,300.

Figure 6:
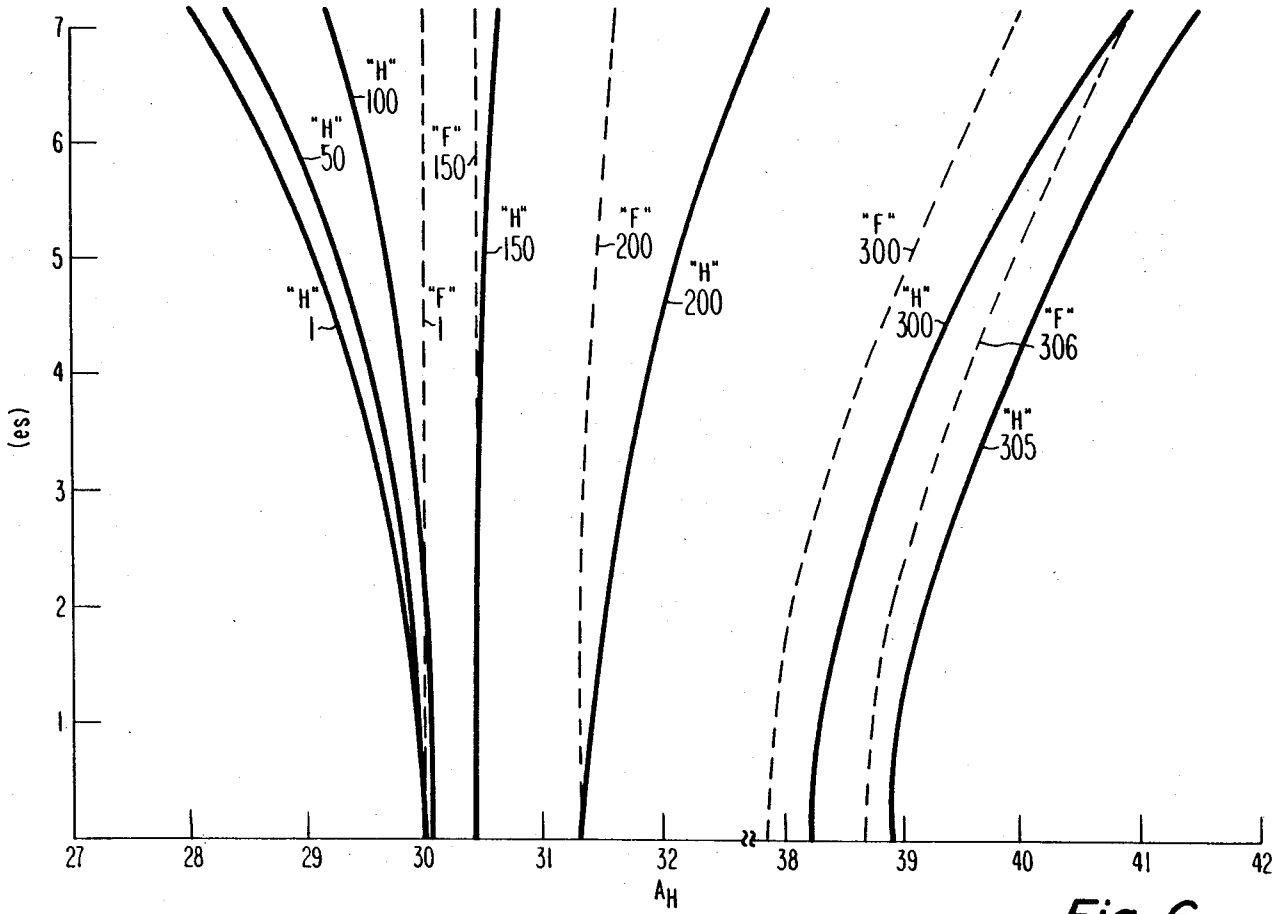
FIG. 6 is a graph of shadow mask aperture column-to-column spacing of the mask of the color picture tube, shown in solid lines, and aperture spacing in a prior mask, shown in dashed lines.
Figure 7:
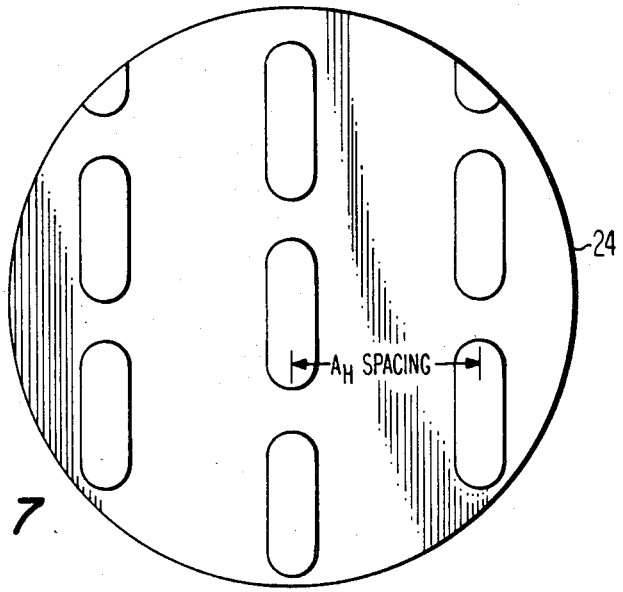
FIG. 7 is an enlarged view of the shadow mask, taken at circle 7 of FIG. 4.

FIG. 6 is a graph showing the aperture column-to-column spacing, $A_H$, within a quadrant of the shadow mask 24, shown in solid curves and labelled "H", and within a quadrant of a shadow mask constructed as described in the above-cited, copending U.S. application Ser. No. 615,589, shown in dashed curves and labelled "F". The vertical coordinate of the graph represents distance from the major axis. The horizontal coordinate represents the aperture column-to-column spacing which, as shown in FIG. 7, is measured from the centerline of one column of the centerline of the adjacent column. Each curve is numbered to identify the space from the minor axis that it represents. For example, each curve marked 200 identifies the spacing between the 200th and 201st aperture columns.

In a prior shadow mask, shown by the dashed curves, the aperture column-to-column spacing is uniform along and near the minor axis, as indicated by the straight curves "F"-1 and "F"-150. A slight curvature can be noted in line "F" 200, indicating that the column-to-column spacing for space 200 is slightly increasing with distance from the major axis. Curves "F"-300 and "F"-306 have considerable bow in them, indicating a substantial increase in column-to-column spacing with increased distance from the major axis.

The aperture column-to-column spacing of the improved shadow mask 24 differs considerably from that of the prior mask near the minor axis. As shown in FIG. 6, the aperture column-to-column spacing, $A_H$, near the minor axis, decreases with increasing distance from the major axis, as shown by curves "H"-1, "H"-50 and "H"-100. Near the 150th space, the aperture column-to-column spacing begins to slightly increase with increasing distance from the major axis, as shown by the slight bow in curve "H"-150. This bowing of the curves, representing aperture column-to-column spacing, increases with distance from the minor axis, as shown by curves "H"-200 and "H"-300, but slightly decreases at the sides of the mask, as can be seen by comparing curve "H"-305 which curve "H"-300.

The aperture column-to-column spacing along the major axis increases approximately as a function of the fourth power of distance from the minor axis. In the particular example shown in FIG. 6, this major axis variation, in mils, is approximately, $A_H=30+0.00185X^4$. However, off the major axis, the aperture column-to-column spacing variation is more complex and varies approximately as the equation, $A_H=a+bx^2+cx^4$; where: a, b and c are different functions of the square of the distance from the major axis, and x is the distance from the minor axis.

Figure 8:
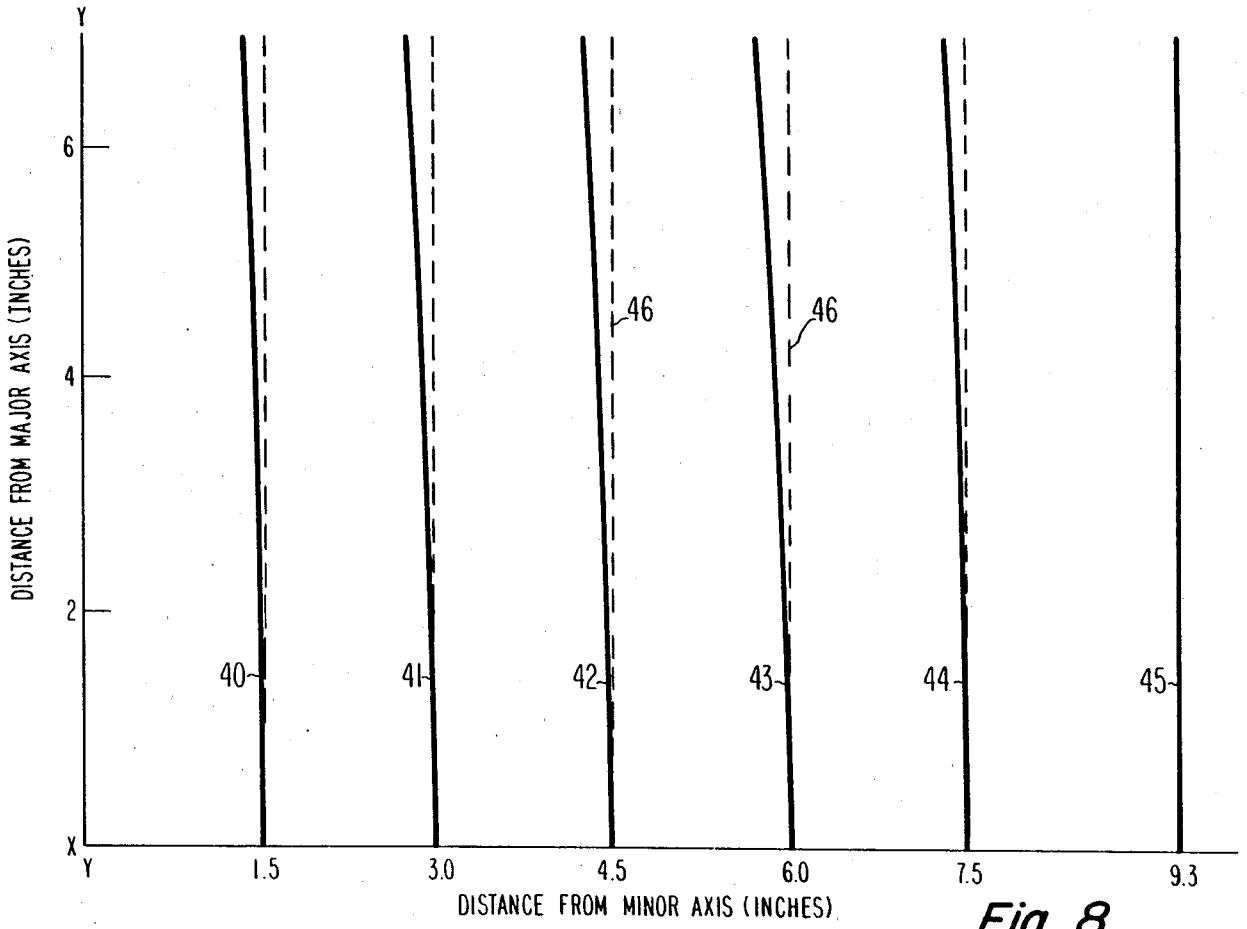
FIG. 8 is a graph of selected screen lines of the color picture tube.

The screen 22 of the tube 10 is formed in a known photographic process that uses the shadow mask 24 as a photographic master. As previously mentioned, there is a problem that occurs when a linear light source is used during an exposure step of the photographic process. This problem is a misalignment of the image of the linear light source with the centerlines of the phosphor lines. This misalignment, also referred to as "skew error", broadens the light intensity distribution used to print the phosphor lines and thereby increases the sensitivity of the phosphor width to light exposure, thus making the control of line width more difficult. In the prior art, compensation has been made for this skew error by various means, including a zonal exposure technique of synchronizing a tilt of the linear light source with a sequential exposure of different screen areas, such as shown in U.S. Pat. No. 3,888,673, issued to Suzuki et al. on June 10, 1975, and a bowing of aperture columns and phosphor lines, such as shown in U.S. Pat. No. 3,889,145, issued to Suzuki et al. on June 10, 1975. In the novel tube 10, the skew problem is solved by a novel phosphor line pattern which, when viewed in front plan view, includes straight lines at the minor axis, bowed lines in a region of the screen where the skew error is the greatest and straight lines at the sides of the screen where skew error in the present tube is minimum. Such pattern is shown in FIG. 8, wherein the solid lines 40 to 45 represent selected spaced phosphor lines, and the dashed lines 46 represent straight lines parallel to the minor axis. As can be seen, the curvature of the phosphor lines increases with increasing distance from the minor axis, until a maximum curvature in the line 42 to line 43 vicinity, and then decreases until the end line 45 which is straight.

What is claimed is:

1. In a color picture tube including a shadow mask mounted adjacent to a line screen, said shadow mask including a plurality of slit-shaped apertures therein located in columns, said line screen having a substantially rectangular periphery with two opposing long sides and two opposing short sides, a major axis of said screen being an axis passing through the center of the screen and centrally extending through the short sides, and a minor axis of said screen being an axis passing through the center of the screen and centrally extending through the long sides, and said screen including cathodoluminescent lines generally extending in the same direction as the minor axis, the improvement comprising the cathodoluminescent lines of said screen, in plan front view, first increasing in curvature and then decreasing in curvature with increasing distance from the minor axis, to become approximately straight at the short sides of the screen, the curvature of the screen lines being concave facing the minor axis.

2. In a color picture tube including a shadow mask mounted adjacent a line screen, said shadow mask including a plurality of slit-shaped apertures therein located in columns, said line screen having a substantially rectangular periphery with two opposing long sides and two opposing short sides, a major axis of said screen being an axis passing through the center of the screen and centrally extending through the short sides, and a minor axis of said screen being an axis passing through the center of the screen and centrally extending through the long sides, and said screen including cathodoluminescent lines generally extending in the same direction as the minor axis, the improvement comprising the cathodoluminescent lines of said screen, in plan front view, being straight at the minor axis of said screen and at the two short sides of said screen and the lines of said screen in an area between the minor axis and the short sides of said screen being curved, the curvature of which is concave facing the minor axis.

* * * * *